US008074946B2

(12) United States Patent
Goetz

(10) Patent No.: US 8,074,946 B2
(45) Date of Patent: Dec. 13, 2011

(54) HOSE HANGER ASSEMBLY HAVING CAR WHEEL RIM CONFIGURATION WITH REMOVABLE COVER STRUCTURE

(75) Inventor: Michael H. Goetz, Berlin, PA (US)

(73) Assignee: Robert Bosch GmbH, Stuttgart (DE)

( * ) Notice: Subject to any disclaimer, the term of this patent is extended or adjusted under 35 U.S.C. 154(b) by 424 days.

(21) Appl. No.: 12/345,935

(22) Filed: Dec. 30, 2008

(65) Prior Publication Data

US 2010/0163690 A1 Jul. 1, 2010

(51) Int. Cl.
*B05B 15/06* (2006.01)
*B65H 75/34* (2006.01)

(52) U.S. Cl. ..... 248/89; 248/75; 248/91; 137/355.12; 137/355.16; 206/398

(58) Field of Classification Search ..... 248/80, 248/89, 90–93, 75, 79, 51, 311.2, 312; 137/355.12, 137/355.16, 355.23, 355.26; 301/37.101, 301/35.632, 37.105, 39.1; 206/389, 398
See application file for complete search history.

(56) References Cited

U.S. PATENT DOCUMENTS

| | | | | | |
|---|---|---|---|---|---|
| D37,306 | S | | 1/1905 | Gibbs | |
| 0,955,260 | A | | 4/1910 | Getman | |
| 1,165,277 | A | * | 12/1915 | Munson | 137/355.12 |
| 1,284,022 | A | | 11/1918 | Wright | |
| 3,774,630 | A | * | 11/1973 | Prange | 137/355.12 |
| 3,958,594 | A | * | 5/1976 | Masters | 137/355.17 |
| 3,976,260 | A | | 8/1976 | Irik | |
| 4,512,361 | A | * | 4/1985 | Tisbo et al. | 137/355.27 |
| D322,746 | S | | 12/1991 | Sassano | |
| 5,238,105 | A | * | 8/1993 | Smiley | 206/223 |
| D341,770 | S | | 11/1993 | Spear et al. | |
| 5,699,987 | A | | 12/1997 | Romaneschi et al. | |
| D390,449 | S | | 2/1998 | Whitehead et al. | |
| D408,270 | S | | 4/1999 | Tisbo et al. | |
| 6,209,204 | B1 | * | 4/2001 | Eikhoff | 29/894.381 |
| 6,305,409 | B1 | * | 10/2001 | Furness | 137/355.16 |
| 6,488,240 | B1 | | 12/2002 | Brooker et al. | |
| D474,396 | S | | 5/2003 | Tisbo et al. | |
| 6,672,676 | B2 | * | 1/2004 | Zaniboni | 301/37.101 |
| 6,953,049 | B2 | * | 10/2005 | Kowalke | 137/355.23 |
| 2002/0074462 | A1 | | 6/2002 | Pontecorvo | |
| 2008/0067860 | A1 | * | 3/2008 | Van Houten | 301/35.632 |

* cited by examiner

*Primary Examiner* — Tan Le
(74) *Attorney, Agent, or Firm* — Maginot, Moore & Beck

(57) ABSTRACT

A hose hanger assembly includes a tubular support, at least one mount, a flange structure, and a cover structure. The tubular support defines a first end, a second end, and a storage compartment located therebetween, the first end of the tubular support defining an access opening aligned with the storage compartment. The at least one mount is attached to the second end of the tubular support. The flange structure includes (i) an inner ring member attached in fixed relation to the first end of the tubular support, (ii) an outer ring member spaced apart from the inner ring member, and (iii) and a plurality of links interconnecting the outer ring member and the inner ring member so as to define a plurality of windows, the flange structure being configured to resemble a wheel rim flange. The cover structure is movable between (i) a first position in which the cover structure is located to cover the access opening, and (ii) a second position in which the cover structure is located to expose the access opening. The cover structure possesses a facade structure that includes (i) a first portion configured to resemble a hub cap, and (ii) a second portion configured to have a plurality of protrusions each being configured to resemble a drive portion of a lug nut. The plurality of protrusions is positioned to surround the first portion.

16 Claims, 8 Drawing Sheets

HOSE HANGER ASSEMBLY HAVING CAR WHEEL RIM CONFIGURATION WITH REMOVABLE COVER STRUCTURE

CROSS REFERENCE

Cross reference is made to copending U.S. patent application Ser. No. 29/330,134, entitled "Hose Hanger" by Michael H. Goetz, now U.S. Design patent No. D604,590, which is assigned to the same assignee as the present invention, and which is filed on the same date herewith, and the disclosure of such patent application is herein incorporated by reference in its entirety.

BACKGROUND

The present disclosure relates generally to hose hangers, and more particularly to a hose hanger assembly that possesses a car wheel rim configuration with a removable cover structure.

Devices configured to hang a hose adjacent to a side of a house are well known in the art. It is also well known in the art to provide one or more storage compartments within the hose hanger. It would be advantageous to create an amusing configuration of a hose hanger that includes a storage compartment which takes advantage of the physical attributes of the amusing configuration for utilitarian purposes.

SUMMARY

In accordance with one embodiment of the present disclosure, there is disclosed a hose hanger assembly that includes a tubular support, at least one mount, a flange structure, and a cover structure. The tubular support defines a first end, a second end, and a storage compartment located therebetween, the first end of the tubular support defining an access opening aligned with the storage compartment. The at least one mount is attached to the second end of the tubular support. The flange structure includes (i) an inner ring member attached in fixed relation to the first end of the tubular support, (ii) an outer ring member spaced apart from the inner ring member, and (iii) and a plurality of links interconnecting the outer ring member and the inner ring member so as to define a plurality of windows, the flange structure being configured to resemble a wheel rim flange. The cover structure is movable between (i) a first position in which the cover structure is located to cover the access opening, and (ii) a second position in which the cover structure is located to expose the access opening. The cover structure possesses a facade structure that includes (i) a first portion configured to resemble a hub cap, and (ii) a second portion configured to have a plurality of protrusions each being configured to resemble a drive portion of a lug nut. The plurality of protrusions is positioned to surround the first portion.

Pursuant to another embodiment of the present disclosure, there is disclosed a hollow support, at least one mount, a flange structure, and a cover structure. The hollow support defines a storage compartment and an access opening leading to the storage compartment. The at least one mount is attached to the hollow support. The flange structure is attached in fixed relation to the hollow support, the flange structure being configured to resemble a wheel rim flange. The cover structure is movable between (i) a first position in which the cover structure is located to cover the access opening, and (ii) a second position in which the cover structure is located to expose the access opening. The cover structure possesses a facade structure that includes (i) a first portion configured to resemble a hub cap, and (ii) a second portion configured to have a plurality of protrusions each being configured to resemble a drive portion of a lug nut, the plurality of protrusions being positioned to surround the first portion.

DESCRIPTION OF THE PREFERRED EMBODIMENTS

Figure 1:
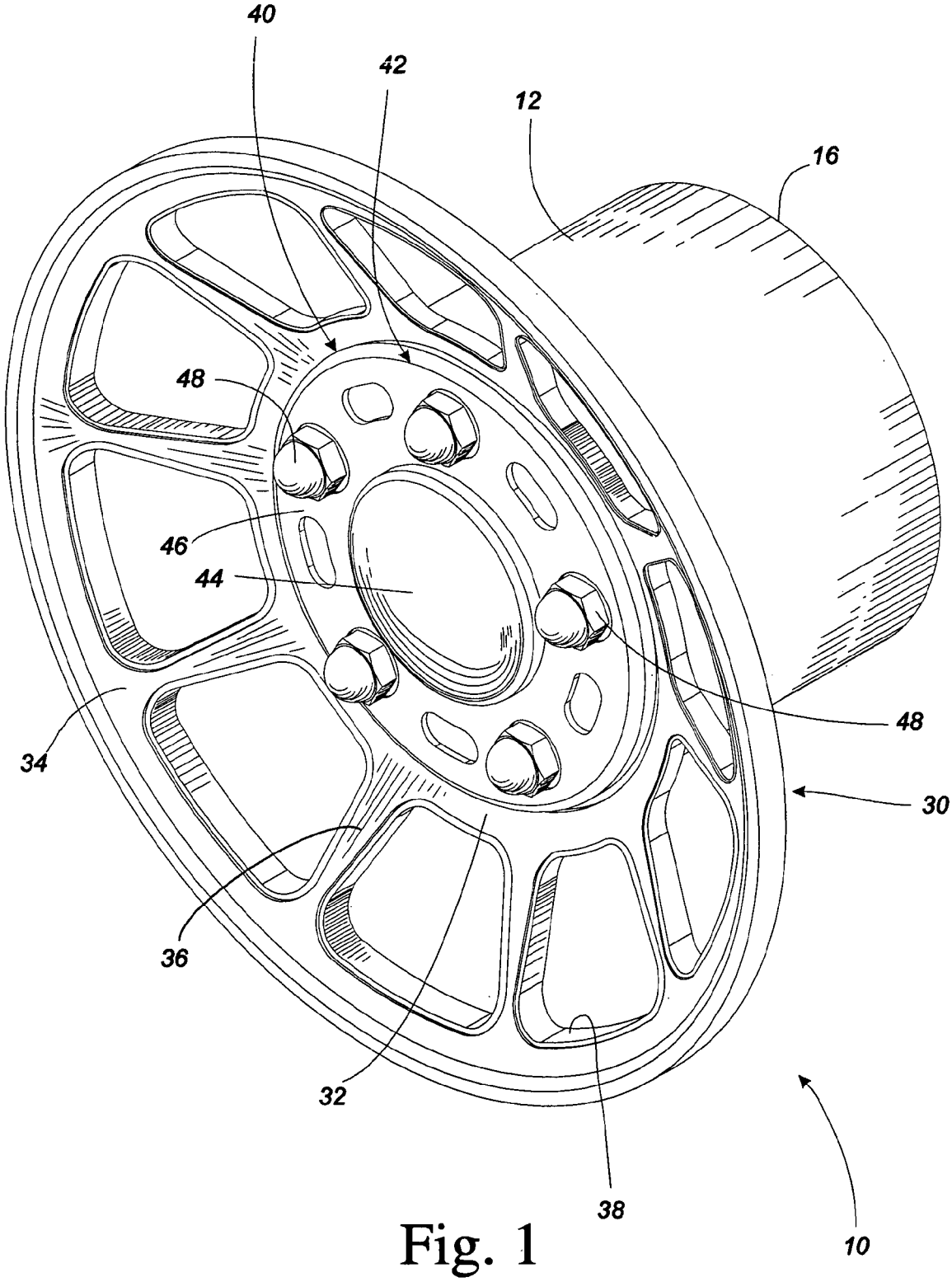
FIG. 1 is a perspective view of a hose hanger assembly of the present disclosure.
Figure 2:
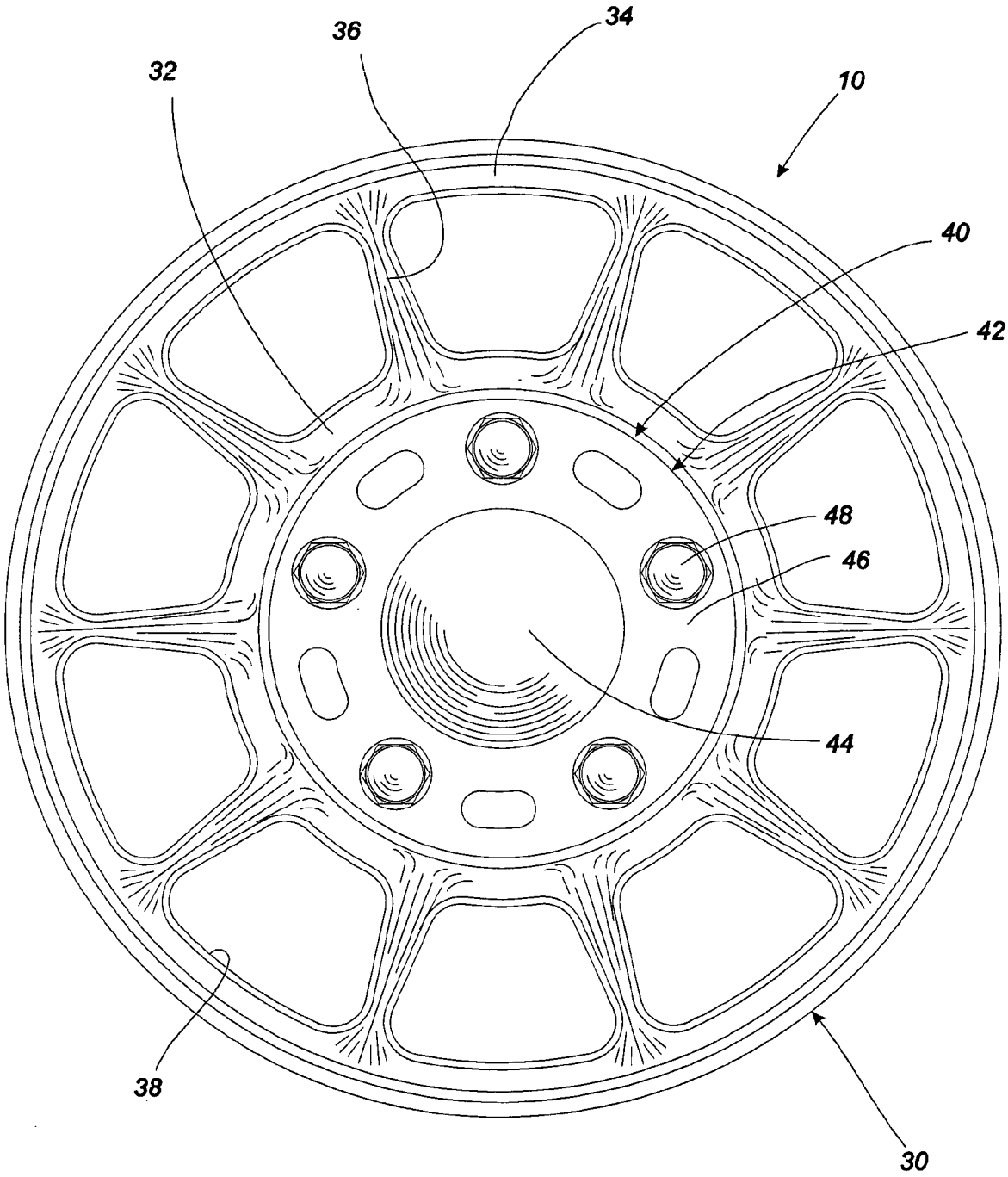
FIG. 2 is a front elevational view of the hose hanger assembly of FIG. 1.
Figure 3:
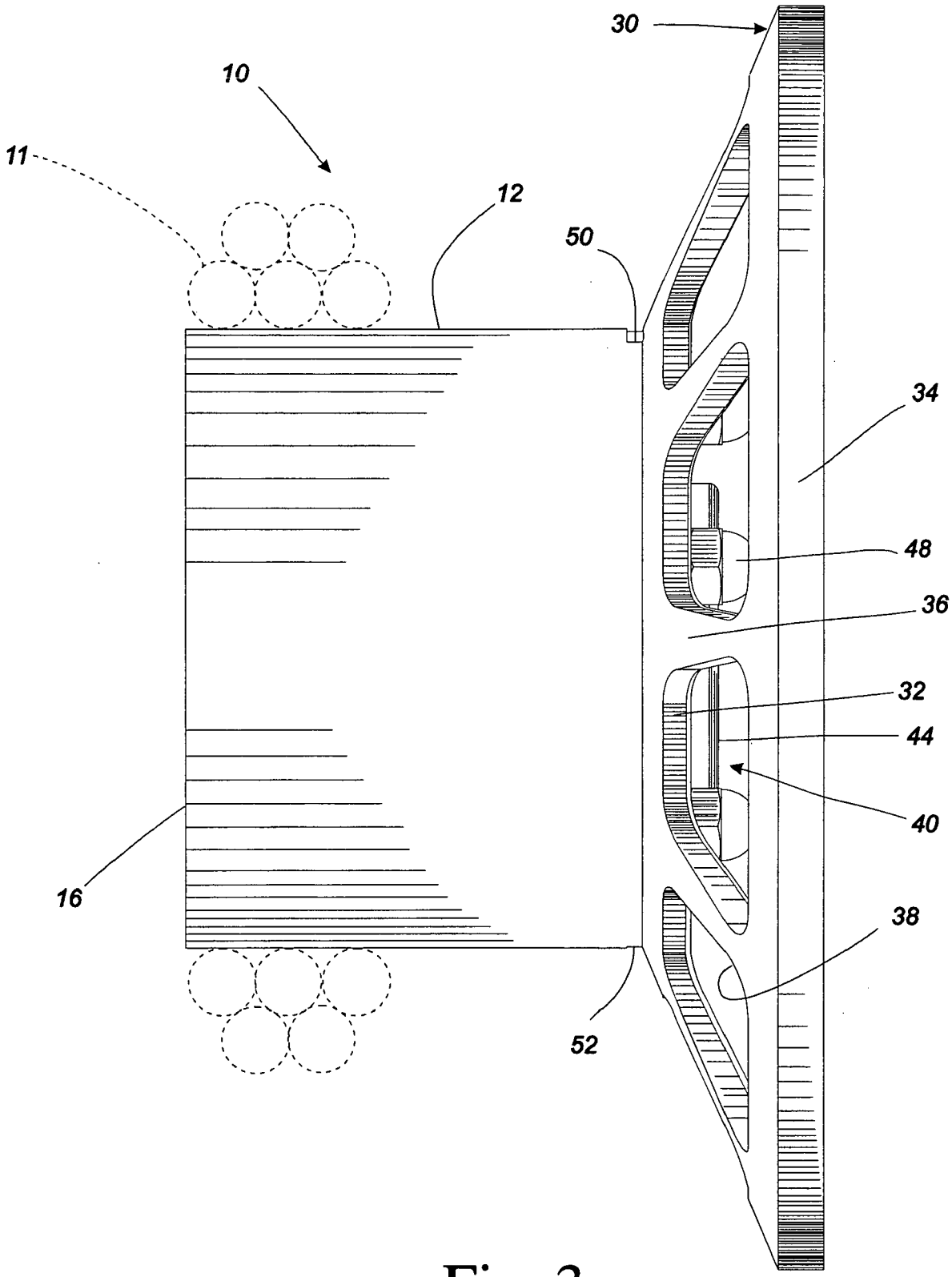
FIG. 3 is a left side elevational view of the hose hanger assembly of FIG. 1.
Figure 4:
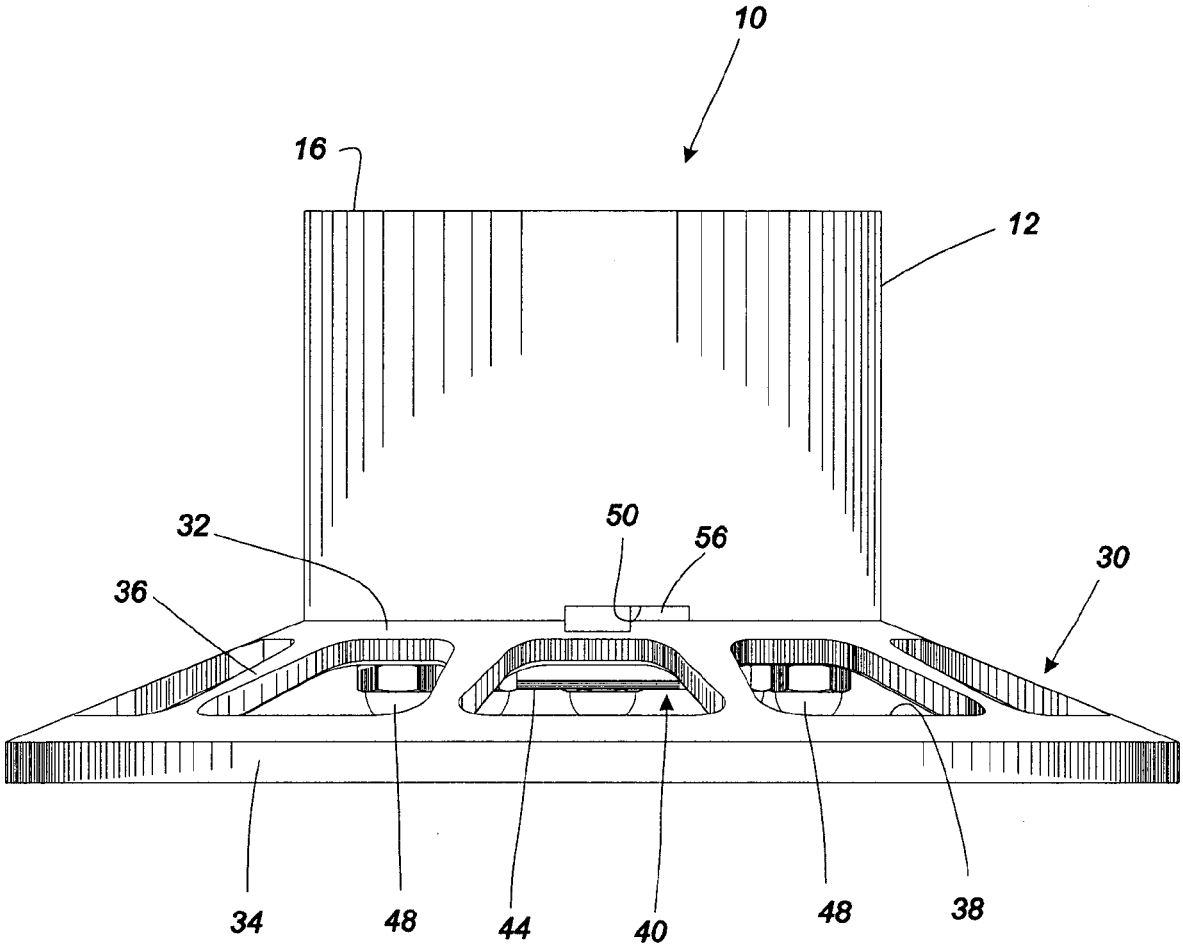
FIG. 4 is a top elevational view of the hose hanger assembly of FIG. 1.
Figure 5:
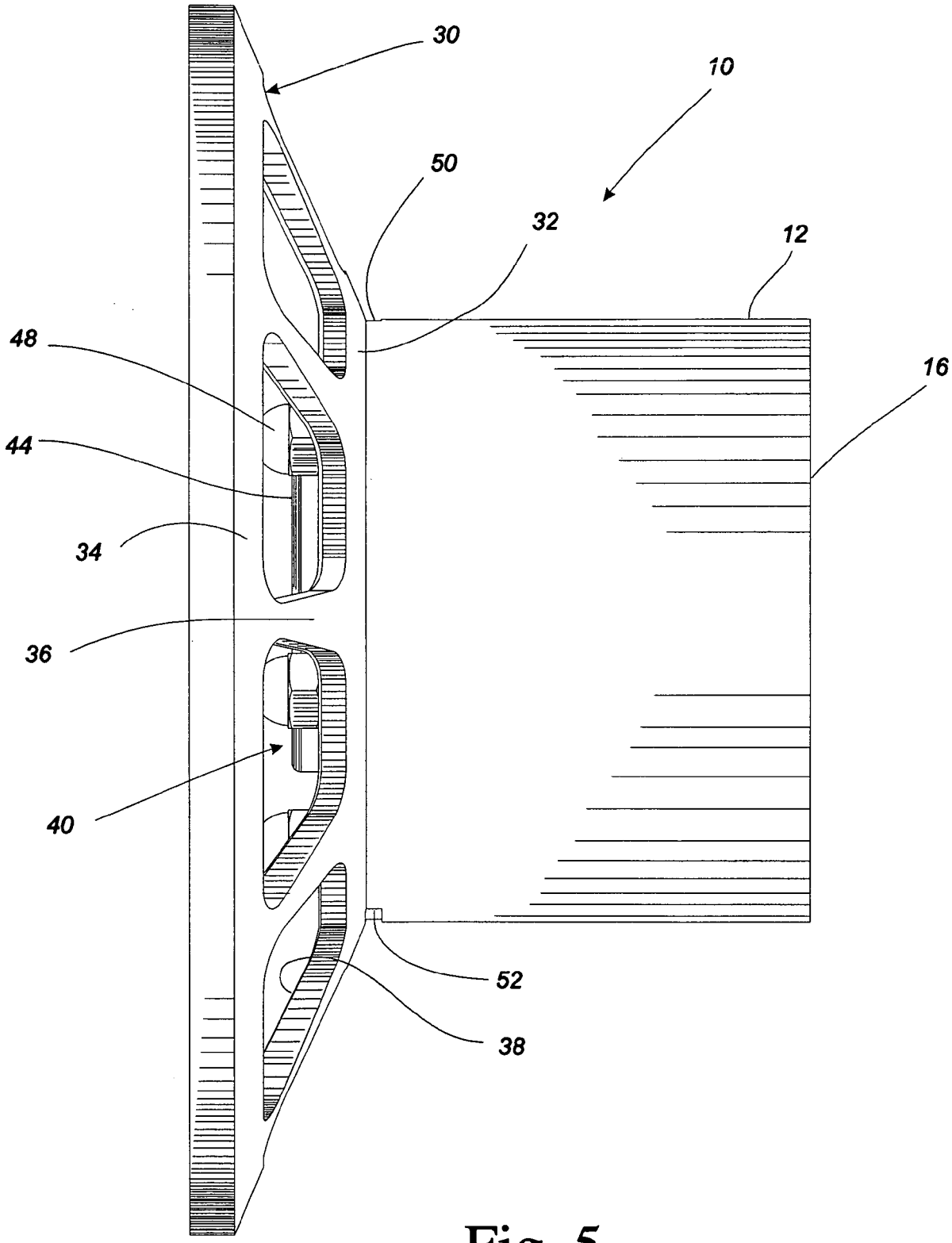
FIG. 5 is a right side elevational view of the hose hanger assembly of FIG. 1.
Figure 6:
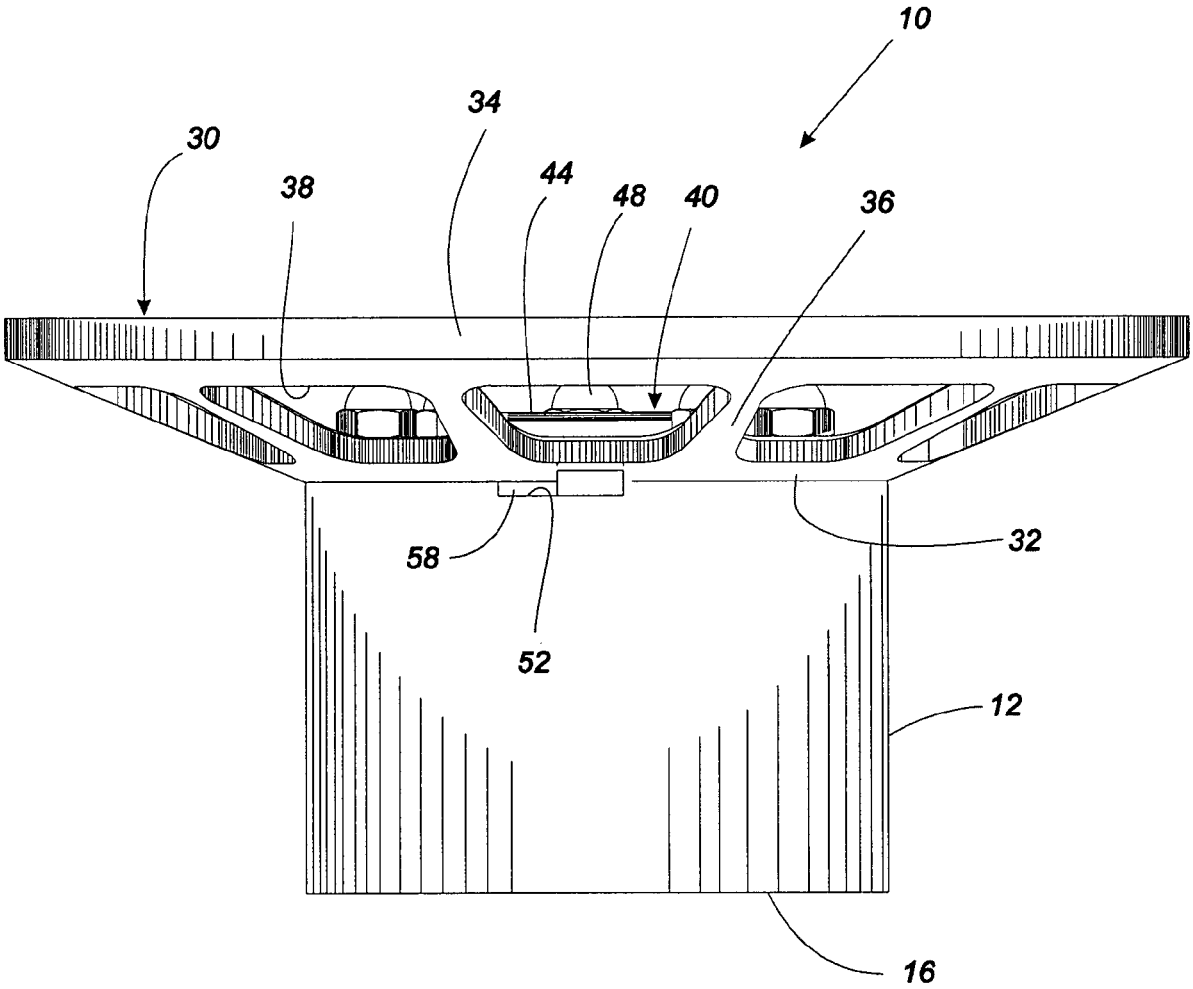
FIG. 6 is a bottom elevational of the hose hanger assembly of FIG. 1.

While the hose hanger assembly described herein is susceptible to various modifications and alternative forms, a specific embodiment thereof has been shown by way of example in the drawings and will herein be described in detail. It should be understood, however, that there is no intent to limit the hose hanger assembly to the particular form disclosed, but on the contrary, the intention is to cover all modifications, equivalents, and alternatives falling within the spirit and scope of the invention as defined by the appended claims.

Figure 7:
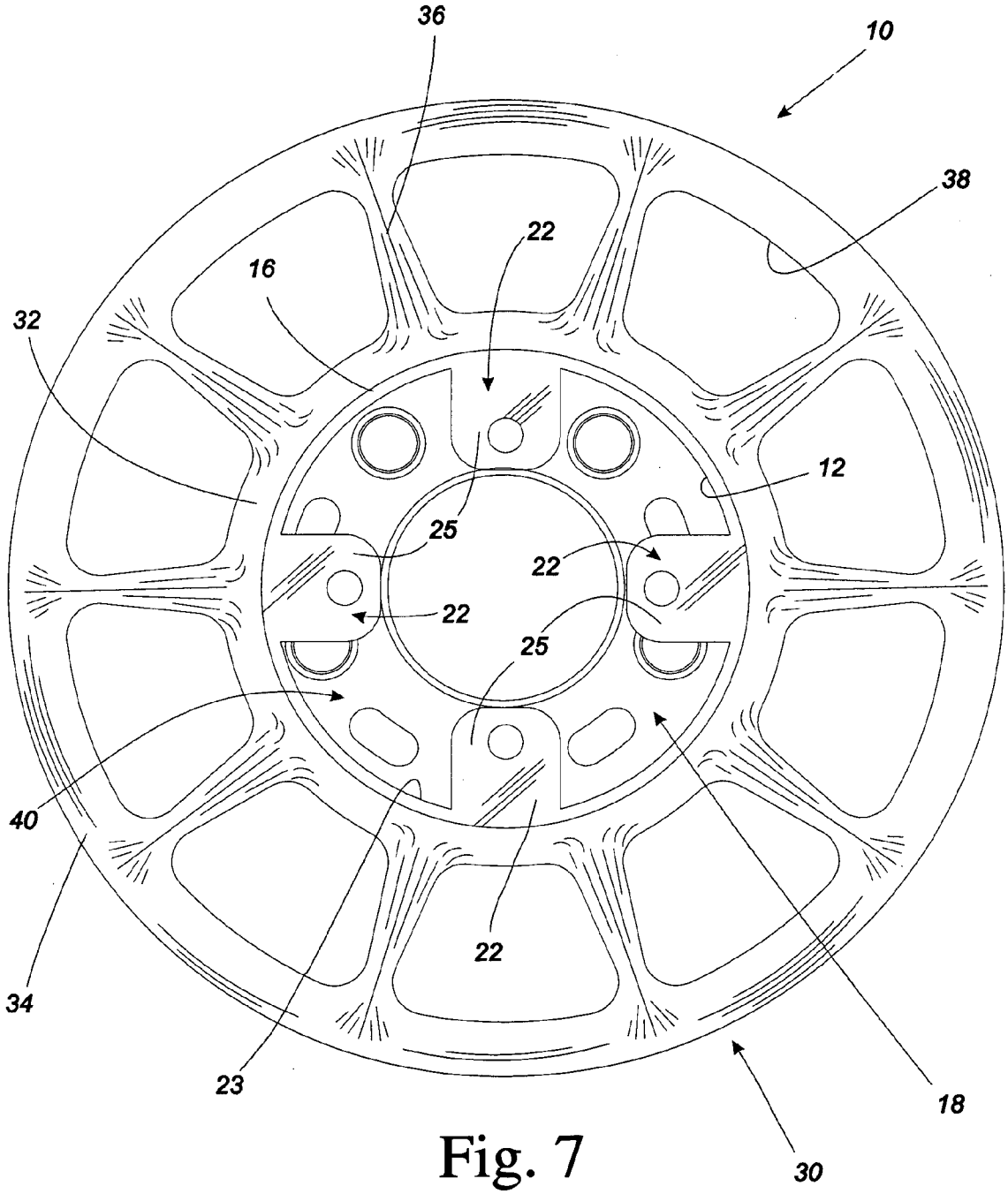
FIG. 7 is a rear elevational view of the hose hanger assembly of FIG. 1.
Figure 8:
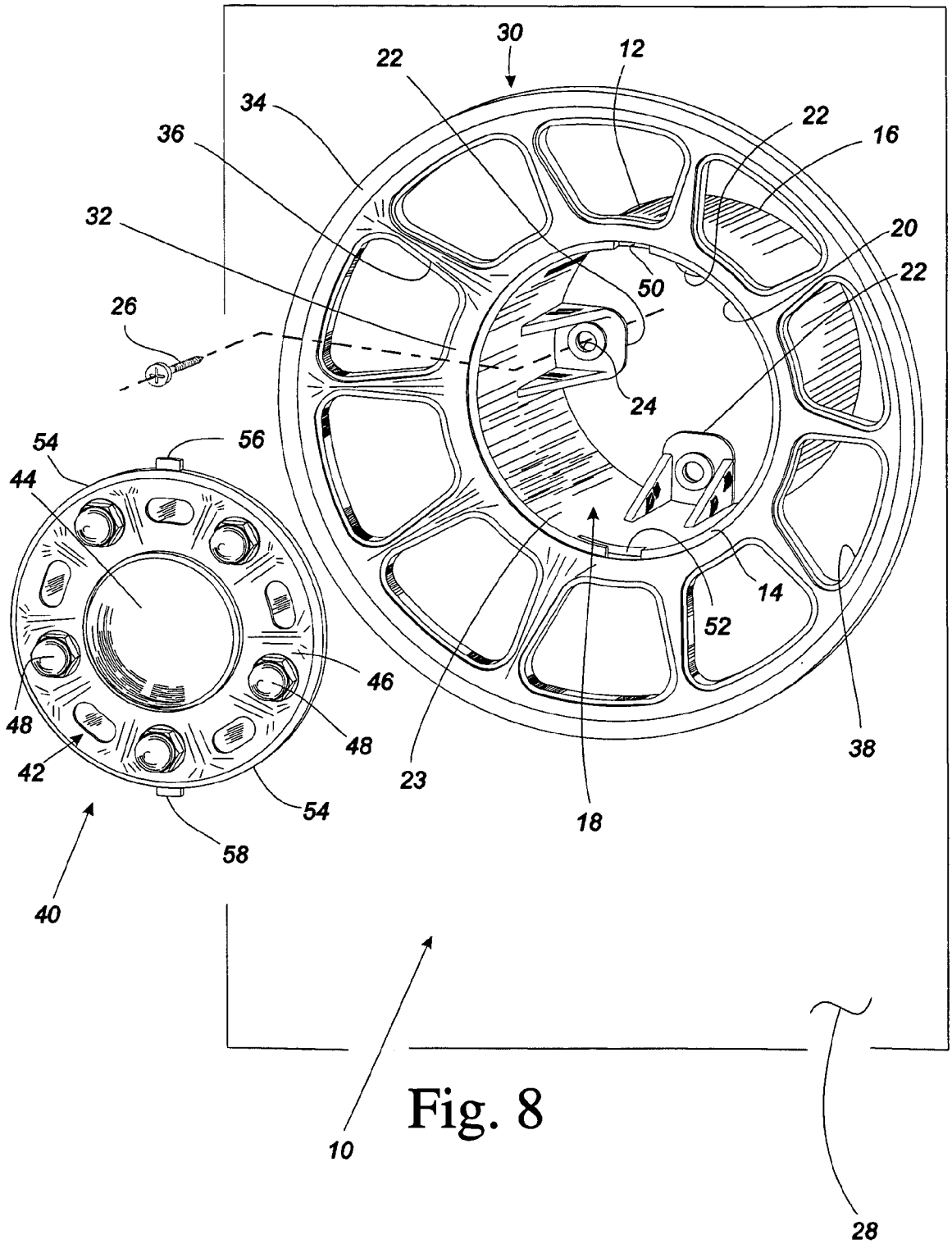
FIG. 8 is an exploded perspective view of the hose hanger assembly of FIG. 1.

Referring now to FIGS. 1-8, there is shown a hose hanger assembly 10 configured in accordance with the present disclosure. The hose hanger assembly 10 includes a tubular support 12 which is hollow. The tubular support 12 supports a garden hose 11 thereon as shown in phantom in FIG. 3. The tubular support 12 includes an end 14 and an opposite end 16. Interposed between its ends 14, 16, the tubular support 12 defines a storage compartment 18 as shown in FIGS. 7 and 8. The storage compartment 18 is configured to stow miscellaneous items used during garden and yard work such as hose nozzles, gloves, pruners, hand weeders, and the like. The first end of the tubular support 12 defines an access opening 20 that is aligned with the storage compartment as shown in FIG. 8.

The hose hanger assembly 10 further includes a plurality of mounts 22 in the form of brackets 22 that are located within the storage compartment 18 as shown in FIGS. 7 and 8. In particular, the tubular structure 12 defines a cylindrically-shaped interior surface 23 that defines the storage compartment 18. Each of the brackets 22 are attached to the cylindrically-shaped interior surface 23 by being integrally formed with the tubular structure 12. Each bracket 22 includes a fastener opening 24 through which a fastener 26 extends when the hose hanger assembly 10 is secured to a wall 28 such as an exterior wall of a house. (Note that only one fastener is shown in FIG. 8 for clarity of description.) Each bracket 22 includes a wall contact portion 25. The wall contact portions 25 are all positioned to be co-planar in relation to each other.

The hose hanger assembly 10 further includes a flange structure 30 that is configured to resemble a flange of a wheel rim of an automobile such as a sports car. The flange structure 30 includes an inner ring member 32 that is fixed in relation to the end 14 of the tubular support 12. In particular, the inner ring member is attached directly to the end 14 of the tubular support by being integrally formed with the tubular support 12 in a molding process. The flange structure 30 further includes an outer ring member 34 that is spaced apart from the inner ring member 32. In addition, the flange structure 30 further includes links or connections 36 that interconnect the outer ring member 34 to the inner ring member 32. The flange structure 30 defines a plurality of windows 38 located between the inner ring member 32 and the outer ring member 34.

The hose hanger assembly 10 additionally includes a cover structure 40 that is positionable between a first position in which the cover structure is located to cover the access opening as shown in FIGS. 1-7 and a second position in which the cover structure is located to expose the access opening 20 as shown in FIG. 8. When the access opening 20 is exposed as shown in FIG. 8, a user is able to access the items (e.g. a hose nozzle) stowed in the storage compartment 18 by advancing his or her hand through the access opening.

The cover structure 40 possesses a facade structure 42 that includes (i) a first portion 44 configured to resemble a hub cap, and (ii) a second portion 46 configured to have a plurality of protrusions 48 each being configured to resemble a drive portion of a lug nut. The plurality of protrusions 48 is positioned to surround the first portion 44.

The cover structure 40 is spaced apart from the tubular support 12 when the cover structure 40 is located in the second position as shown in FIG. 8. On the other hand, the cover structure 40 is attached to the tubular support 12 when the cover structure 40 is located in the first position as shown in FIGS. 1-7. In order to enable the cover structure 40 to be attached to the tubular support 12, the cover structure 40 and the tubular support 12 are configured with connection features. In particular, the tubular support 40 has defined therein a slot 50 and another slot 52 that are spaced apart from each other. The cover structure 40 defines a periphery 54 and includes a tab 56 and another tab 58 each extending radially from the periphery 54. When the cover structure 40 is located in the first position as shown in FIGS. 1-7, the tab 56 is received within the slot 50, and the tab 58 is received within the slot 52.

It should be appreciated the cover structure 40 is preferably formed from a suitable plastic material such as a polymeric material that is durable so as to be able to endure in the outdoor environment such as rain, wind, and snow. Some polymeric materials that may be used to form the cover structure 40 are polyethylene, polypropylene, nylon, and the like. The tubular support 12, the flange structure 30, and the plurality of mounts 22 are integrally formed together in a molding process to form a single part which is made from a polymeric material such as polyethylene, polypropylene, nylon, and the like.

There is a plurality of advantages arising from the various features of the embodiment of the hose hanger assembly described herein. It will be noted that alternative embodiments of the hose hanger assembly may not include all of the features described yet still benefit from at least some of the advantages of such features. Those of ordinary skill in the art may readily devise their own implementations of the hose hanger assembly that incorporate one or more of the features and fall within the spirit and scope of the present invention as defined by the appended claims.

What is claimed is:

1. A hose hanger assembly, comprising:

a tubular support defining a first end, a second end, and a storage compartment located therebetween, said first end of said tubular support defining an access opening aligned with said storage compartment;

at least one mount attached to said second end of said tubular support;

a flange structure including (i) an inner ring member attached in fixed relation to said first end of said tubular support, (ii) an outer ring member spaced apart from said inner ring member, and (iii) and a plurality of links interconnecting said outer ring member and said inner ring member so as to define a plurality of windows, said flange structure being configured to resemble a wheel rim flange;

a cover structure movable between (i) a first position in which said cover structure is located to cover said access opening, and (ii) a second position in which said cover structure is located to expose said access opening, wherein said cover structure possesses a facade structure that includes (i) a first portion configured to resemble a hub cap, and (ii) a second portion configured to have a plurality of protrusions each being configured to resemble a drive portion of a lug nut, said plurality of protrusions being positioned to surround said first portion, wherein said at least one mount is located within said storage compartment, wherein said tubular structure defines a cylindrically-shaped interior surface that defines said storage compartment, and wherein said at least one mount includes at least one bracket attached to said cylindrically-shaped interior surface.

2. A hose hanger assembly, comprising:

a tubular support defining a first end, a second end, and a storage compartment located therebetween, said first end of said tubular support defining an access opening aligned with said storage compartment;

at least one mount attached to said second end of said tubular support;

a flange structure including (i) an inner ring member attached in fixed relation to said first end of said tubular support, (ii) an outer ring member spaced apart from said inner ring member, and (iii) and a plurality of links interconnecting said outer ring member and said inner ring member so as to define a plurality of windows, said flange structure being configured to resemble a wheel rim flange;

a cover structure movable between (i) a first position in which said cover structure is located to cover said access opening, and (ii) a second position in which said cover structure is located to expose said access opening, wherein said cover structure possesses a facade structure that includes (i) a first portion configured to resemble a hub cap, and (ii) a second portion configured to have a plurality of protrusions each being configured to resemble a drive portion of a lug nut, said plurality of protrusions being positioned to surround said first portion, and wherein said at least one mount includes a first bracket, and further comprising a second bracket spaced apart from said first bracket, each of said first bracket and said second bracket being located within said storage compartment.

3. The hose hanger assembly of claim 2, wherein:

said cover structure is attached to said tubular support when said cover structure is located in said first position, and said cover structure is spaced apart from said tubular support when said cover structure is located in said second position.

4. The hose hanger assembly of claim 2, wherein:

said tubular support has defined therein a first slot and a second slot spaced apart from each other, said cover structure defines a periphery and includes a first tab and a second tab each extending radially from said periphery, and when said cover structure is located in said first position, (i) said first tab is positioned in said first slot, and (ii) said second tab is positioned in said second slot.

5. The hose hanger assembly of claim 2, wherein said at least one mount has defined therein a fastener opening, further comprising:

a fastener extending through said fastener opening.

6. The hose hanger assembly of claim 2, wherein:

said tubular structure defines a cylindrically-shaped interior surface that defines said storage compartment, said first bracket is attached to said cylindrically-shaped interior surface, said second bracket is attached to said cylindrically-shaped interior surface, said first bracket defines a first planar wall contact portion, said second bracket defines a second planar wall contact portion, and said first planar wall contact portion and said second planar wall contact portion are located to be co-planar.

7. The hose hanger assembly of claim 2, wherein said cover structure is made of a polymeric material.

8. The hose hanger assembly of claim 2, wherein:

said tubular support and said flange structure are integrally formed together from a polymeric material.

9. A hose hanger assembly, comprising:

a hollow support defining a storage compartment and an access opening leading to said storage compartment;

at least one mount attached to said hollow support;

a flange structure attached in fixed relation to said hollow support, said flange structure being configured to resemble a wheel rim flange;

a cover structure movable between (i) a first position in which said cover structure is located to cover said access opening, and (ii) a second position in which said cover structure is located to expose said access opening, wherein said cover structure possesses a facade structure that includes (i) a first portion configured to resemble a hub cap, and (ii) a second portion configured to have a plurality of protrusions each being configured to resemble a drive portion of a lug nut, said plurality of protrusions being positioned to surround said first portion, wherein said at least one mount is located within said storage compartment and has defined therein a fastener opening, said hose hanger assembly further comprising a fastener extending through said fastener opening, wherein said hollow structure defines an interior surface that defines said storage compartment, and wherein said at least one mount includes at least one bracket attached to said interior surface.

10. The hose hanger assembly of claim 9, wherein:

said cover structure is attached to said hollow support when said cover structure is located in said first position, and said cover structure is spaced apart from said hollow support when said cover structure is located in said second position.

11. The hose hanger assembly of claim 9, wherein:

said hollow support has defined therein a first slot and a second slot spaced apart from each other, said cover structure defines a periphery and includes a first tab and a second tab each extending radially from said periphery, and when said cover structure is located in said first position, (i) said first tab is positioned in said first slot, and (ii) said second tab is positioned in said second slot.

12. The hose hanger assembly of claim 9, wherein said flange structure includes:

an inner ring member attached in fixed relation to said first end of said hollow support, an outer ring member spaced apart from said inner ring member, and a plurality of interconnections interposed between said outer ring member and said inner ring member.

13. The hose hanger assembly of claim 9, wherein cover structure is made of a polymeric material.

14. The hose hanger assembly of claim 9, wherein:

said hollow support and said flange structure are integrally formed together from a polymeric material.

15. A hose hanger assembly, comprising:

a hollow support defining a storage compartment and an access opening leading to said storage compartment;

at least one mount attached to said hollow support;

a flange structure attached in fixed relation to said hollow support, said flange structure being configured to resemble a wheel rim flange;

a cover structure movable between (i) a first position in which said cover structure is located to cover said access opening, and (ii) a second position in which said cover structure is located to expose said access opening, wherein said cover structure possesses a facade structure that includes (i) a first portion configured to resemble a hub cap, and (ii) a second portion configured to have a plurality of protrusions each being configured to resemble a drive portion of a lug nut, said plurality of protrusions being positioned to surround said first portion, and wherein said at least one mount includes a first bracket, and further comprising a second bracket spaced apart from said first bracket, each of said first bracket and said second bracket being located within said storage compartment.

16. The hose hanger assembly of claim 15, wherein:

said hollow structure defines an interior surface that defines said storage compartment, said first bracket is attached to said interior surface, said second bracket is attached to said interior surface, said first bracket defines a first planar wall contact portion, said second bracket defines a second planar wall contact portion, and said first planar wall contact portion and said second planar wall contact portion are located to be co-planar.

* * * * *